US010210873B2

(12) United States Patent
Zhang et al.

(10) Patent No.: US 10,210,873 B2
(45) Date of Patent: Feb. 19, 2019

(54) METHOD AND APPARATUS FOR DETERMINING INTER-CHANNEL TIME DIFFERENCE PARAMETER

(71) Applicant: Huawei Technologies Co., Ltd., Shenzhen (CN)

(72) Inventors: Xingtao Zhang, Shenzhen (CN); Lei Miao, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 35 days.

(21) Appl. No.: 15/698,107

(22) Filed: Sep. 7, 2017

(65) Prior Publication Data

US 2017/0372710 A1 Dec. 28, 2017

Related U.S. Application Data

(63) Continuation of application No. PCT/CN2015/095097, filed on Nov. 20, 2015.

(30) Foreign Application Priority Data

Mar. 9, 2015 (CN) ..... 2015 1 0101315

(51) Int. Cl.
*G10L 19/008* (2013.01)
*G10L 19/022* (2013.01)

(52) U.S. Cl.
CPC ..... *G10L 19/008* (2013.01); *G10L 19/022* (2013.01)

(58) Field of Classification Search
CPC ..... G10L 19/008; G10L 25/06; G10L 25/45
See application file for complete search history.

(56) References Cited

U.S. PATENT DOCUMENTS 8,065,158 B2 11/2011 Liebchen
2004/0039464 A1 2/2004 Virolainen et al.
(Continued)

FOREIGN PATENT DOCUMENTS

CA 2977843 A1 9/2016
CN 101673549 A 3/2010
(Continued)

OTHER PUBLICATIONS

Oomen, Werner, et al. "Advances in parametric coding for high-quality audio." Audio Engineering Society Convention 114. Audio Engineering Society, 2003 (Year: 2003).*
(Continued)

*Primary Examiner* — Brian L Albertalli
(74) *Attorney, Agent, or Firm* — Conley Rose, P.C.

(57) ABSTRACT

A method for determining an inter-channel time difference (ITD) parameter includes determining a reference parameter according to a time-domain signal on a first sound channel and a time-domain signal on a second sound channel, where the reference parameter corresponds to a sequence of obtaining the time-domain signal on the first sound channel and the time-domain signal on the second sound channel, determining a search range according to the reference parameter and a limiting value ($T_{max}$), where the $T_{max}$ is determined according to a sampling rate of the time-domain signal on the first sound channel, and performing search processing within the search range based on a frequency-domain signal on the first sound channel and a frequency-domain signal on the second sound channel to determine a first ITD parameter corresponding to the first sound channel and the second sound channel.

20 Claims, 5 Drawing Sheets

(56) References Cited

U.S. PATENT DOCUMENTS

| | | | | |
|---|---|---|---|---|
| 2007/0291951 | A1 | 12/2007 | Faller | |
| 2008/0215317 | A1 | 9/2008 | Fejzo | |
| 2009/0119111 | A1 | 5/2009 | Goto et al. | |
| 2011/0206223 | A1* | 8/2011 | Ojala | G10L 19/008 381/300 |
| 2012/0033817 | A1* | 2/2012 | Francois | G10L 19/008 381/2 |
| 2013/0279702 | A1 | 10/2013 | Lang et al. | |
| 2013/0304481 | A1 | 11/2013 | Briand et al. | |
| 2015/0010155 | A1 | 1/2015 | Virette et al. | |
| 2015/0049872 | A1 | 2/2015 | Virette et al. | |
| 2016/0078877 | A1* | 3/2016 | Vasilache | G10L 19/008 381/23 |
| 2016/0198279 | A1 | 7/2016 | Briand et al. | |

FOREIGN PATENT DOCUMENTS

| | | | |
|---|---|---|---|
| CN | 103339670 | A | 10/2013 |
| CN | 103403800 | A | 11/2013 |
| EP | 2671221 | | 12/2013 |
| JP | 2008530603 | A | 8/2008 |
| JP | 2013540283 | A | 10/2013 |
| JP | 2015514234 | A | 5/2015 |
| JP | 2015518176 | A | 6/2015 |
| RU | 2495502 | C2 | 10/2013 |
| WO | 2006084916 | A2 | 8/2006 |
| WO | 2007052612 | A1 | 5/2007 |
| WO | 2010142320 | A1 | 12/2010 |
| WO | 2012105885 | A1 | 8/2012 |
| WO | 2012105886 | A1 | 8/2012 |
| WO | 2013120351 | A1 | 8/2013 |
| WO | 2016141731 | A1 | 9/2016 |

OTHER PUBLICATIONS

Herre, Jürgen, et al. "MPEG surround-the ISO/MPEG standard for efficient and compatible multichannel audio coding." Journal of the Audio Engineering Society 56.11 (2008): 932-955 (Year: 2008).*

Baumgarte, Frank, and Christof Faller. "Estimation of auditory spatial cues for binaural cue coding." Acoustics, Speech, and Signal Processing (ICASSP), 2002 IEEE International Conference on. vol. 2. IEEE, 2002. (Year: 2002).*

Herre, J., et al. "The reference model architecture for MPEG spatial audio coding." Preprint 118th Conv Aud. Eng. Soc.. No. LCAV-CONF-2005-031. 2005 (Year: 2005).*

Foreign Communication From a Counterpart Application, Japanese Application No. 2017-547541, Japanese Office Action dated Oct. 15, 2018, 3 pages.

Foreign Communication From a Counterpart Application, Japanese Application No. 2017-547541, English Translation of Japanese Office Action dated Oct. 15, 2018, 4 pages.

"New Annex F with Stereo embedded extension for ITU-T G.711.1" XP044050912, vol. 10/16, May 9, 2012, 52 pages.

Foreign Communication From a Counterpart Application, European Application No. 15884410.0, Extended European Search Report dated Nov. 15, 2017, 10 pages.

Machine Translation and Abstract of Chinese Publication No. CN101673549, Mar. 17, 2010, 18 pages.

Foreign Communication From a Counterpart Application, PCT Application No. PCT/CN2015/095097, English Translation of International Search Report dated Feb. 26, 2016, 2 pages.

Foreign Communication From a Counterpart Application, PCT Application No. PCT/CN2015/095097, English Translation of Written Opinion dated Feb. 26, 2016, 6 pages.

Foreign Communication From a Counterpart Application, Russian Application No. 2017135269, Russian Decision on Grant dated Aug. 21, 2018, 10 pages.

Foreign Communication From a Counterpart Application, Russian Application No. 2017135269, English Translation of Russian Decision on Grant dated Aug. 21, 2018, 7 pages.

Foreign Communication From a Counterpart Application, Russian Application No. 2017135269/08, Russian Search Report dated Aug. 20, 2018, 2 pages.

Foreign Communication From a Counterpart Application, Russian Application No. 2017135269/08, English Translation of Russian Search Report dated Aug. 20, 2018, 3 pages.

* cited by examiner

METHOD AND APPARATUS FOR DETERMINING INTER-CHANNEL TIME DIFFERENCE PARAMETER

CROSS-REFERENCE TO RELATED APPLICATIONS

This application is a continuation of International Patent Application No. PCT/CN2015/095097 filed on Nov. 20, 2015, which claims priority to Chinese Patent Application No. 201510101315.X filed on Mar. 9, 2015. The disclosures of the aforementioned applications are hereby incorporated by reference in their entireties.

TECHNICAL FIELD

The present disclosure relates to the audio processing field, and in particular, to a method and an apparatus for determining an inter-channel time difference (ITD) parameter.

BACKGROUND

Improvement in quality of life is accompanied with people's ever-increasing requirements for high-quality audio. Compared with mono audio, stereo audio provides sense of direction and sense of distribution of sound sources and can improve clarity and intelligibility of information, and is therefore highly favored by people.

Currently, there is a known technology for transmitting a stereo audio signal. An encoder converts a stereo signal into a mono audio signal and a parameter such as an ITD, separately encodes the mono audio signal and the parameter, and transmits an encoded mono audio signal and an encoded parameter to a decoder. After obtaining the mono audio signal, the decoder further restores the stereo signal according to the parameter such as the ITD. Therefore, low-bit and high-quality transmission of the stereo signal can be implemented.

In the foregoing technology, based on a sampling rate of a time-domain signal on mono audio, the encoder can determine a limiting value $T_{max}$ of an ITD parameter at the sampling rate, and therefore may perform searching and calculation subband by subband within a range $[-T_{max}, T_{max}]$ based on a frequency-domain signal, to obtain the ITD parameter.

However, the foregoing relatively large search range causes a large calculation amount in a process of determining an ITD parameter in a frequency domain in other approaches. Consequently, a performance requirement for an encoder increases, and processing efficiency is affected.

Therefore, a technology is expected to be provided such that a calculation amount in a process of searching for and calculating an ITD parameter can be reduced while accuracy of the ITD parameter is ensured.

SUMMARY

Embodiments of the present disclosure provide a method and an apparatus for determining an ITD parameter to reduce a calculation amount in a process of searching for and calculating an ITD parameter in a stereo encoding process.

According to a first aspect, a method for determining an ITD parameter is provided, where the method includes determining a reference parameter according to a time-domain signal on a first sound channel and a time-domain signal on a second sound channel, where the reference parameter corresponds to a sequence of obtaining the time-domain signal on the first sound channel and the time-domain signal on the second sound channel, and the time-domain signal on the first sound channel and the time-domain signal on the second sound channel correspond to a same time period, determining a search range according to the reference parameter and a limiting value $T_{max}$, where the limiting value $T_{max}$ is determined according to a sampling rate of the time-domain signal on the first sound channel, and the search range falls within $[-T_{max}, 0]$, or the search range falls within $[0, T_{max}]$, and performing search processing within the search range based on a frequency-domain signal on the first sound channel and a frequency-domain signal on the second sound channel to determine a first ITD parameter corresponding to the first sound channel and the second sound channel.

With reference to the first aspect, in a first implementation of the first aspect, determining the reference parameter according to a time-domain signal on a first sound channel and a time-domain signal on a second sound channel includes performing cross-correlation processing on the time-domain signal on the first sound channel and the time-domain signal on the second sound channel to determine a first cross-correlation processing value and a second cross-correlation processing value, where the first cross-correlation processing value is a maximum function value, within a preset range, of a cross-correlation function of the time-domain signal on the first sound channel relative to the time-domain signal on the second sound channel, and the second cross-correlation processing value is a maximum function value, within the preset range, of a cross-correlation function of the time-domain signal on the second sound channel relative to the time-domain signal on the first sound channel, and determining the reference parameter according to a value relationship between the first cross-correlation processing value and the second cross-correlation processing value.

With reference to the first aspect and the foregoing implementation of the first aspect, in a second implementation of the first aspect, the reference parameter is an index value corresponding to a larger one of the first cross-correlation processing value and the second cross-correlation processing value, or an opposite number of the index value.

With reference to the first aspect and the foregoing implementation of the first aspect, in a third implementation of the first aspect, determining the reference parameter according to a time-domain signal on a first sound channel and a time-domain signal on a second sound channel includes performing peak detection processing on the time-domain signal on the first sound channel and the time-domain signal on the second sound channel to determine a first index value and a second index value, where the first index value is an index value corresponding to a maximum amplitude value of the time-domain signal on the first sound channel within a preset range, and the second index value is an index value corresponding to a maximum amplitude value of the time-domain signal on the second sound channel within the preset range, and determining the reference parameter according to a value relationship between the first index value and the second index value.

With reference to the first aspect or any one of the foregoing implementations of the first aspect, in a fourth implementation of the first aspect, the method further includes performing smoothing processing on the first ITD parameter based on a second ITD parameter, where the first ITD parameter is an ITD parameter in a first time period, the second ITD parameter is a smoothed value of an ITD parameter in a second time period, and the second time period is before the first time period.

According to a second aspect, an apparatus for determining an ITD parameter is provided, where the apparatus includes a determining unit configured to determine a reference parameter according to a time-domain signal on a first sound channel and a time-domain signal on a second sound channel, where the reference parameter corresponds to a sequence of obtaining the time-domain signal on the first sound channel and the time-domain signal on the second sound channel, and the time-domain signal on the first sound channel and the time-domain signal on the second sound channel correspond to a same time period, and determine a search range according to the reference parameter and a limiting value $T_{max}$, where the limiting value $T_{max}$ is determined according to a sampling rate of the time-domain signal on the first sound channel, and the search range falls within $[-T_{max}, 0]$, or the search range falls within $[0, T_{max}]$, and a processing unit configured to perform search processing within the search range based on a frequency-domain signal on the first sound channel and a frequency-domain signal on the second sound channel to determine a first ITD parameter corresponding to the first sound channel and the second sound channel.

With reference to the second aspect, in a first implementation of the second aspect, the determining unit is further configured to perform cross-correlation processing on the time-domain signal on the first sound channel and the time-domain signal on the second sound channel to determine a first cross-correlation processing value and a second cross-correlation processing value, and determine the reference parameter according to a value relationship between the first cross-correlation processing value and the second cross-correlation processing value, where the first cross-correlation processing value is a maximum function value, within a preset range, of a cross-correlation function of the time-domain signal on the first sound channel relative to the time-domain signal on the second sound channel, and the second cross-correlation processing value is a maximum function value, within the preset range, of a cross-correlation function of the time-domain signal on the second sound channel relative to the time-domain signal on the first sound channel.

With reference to the second aspect and the foregoing implementation of the second aspect, in a second implementation of the second aspect, the determining unit is further configured to determine an index value corresponding to a larger one of the first cross-correlation processing value and the second cross-correlation processing value or an opposite number of the index value as the reference parameter.

With reference to the second aspect and the foregoing implementation of the second aspect, in a third implementation of the second aspect, the determining unit is further configured to perform peak detection processing on the time-domain signal on the first sound channel and the time-domain signal on the second sound channel to determine a first index value and a second index value, and determine the reference parameter according to a value relationship between the first index value and the second index value, where the first index value is an index value corresponding to a maximum amplitude value of the time-domain signal on the first sound channel within a preset range, and the second index value is an index value corresponding to a maximum amplitude value of the time-domain signal on the second sound channel within the preset range.

With reference to the second aspect or any one of the foregoing implementations of the second aspect, in a fourth implementation of the second aspect, the processing unit is further configured to perform smoothing processing on the first ITD parameter based on a second ITD parameter, where the first ITD parameter is an ITD parameter in a first time period, the second ITD parameter is a smoothed value of an ITD parameter in a second time period, and the second time period is before the first time period.

According to the method and the apparatus for determining an ITD parameter in the embodiments of the present disclosure, a reference parameter corresponding to a sequence of obtaining a time-domain signal on a first sound channel and a time-domain signal on a second sound channel is determined in a time domain, a search range can be determined based on the reference parameter, and search processing on a frequency-domain signal on the first sound channel and a frequency-domain signal on the second sound channel is performed within the search range in a frequency domain to determine an ITD parameter corresponding to the first sound channel and the second sound channel. In the embodiments of the present disclosure, the search range determined according to the reference parameter falls within $[-T_{max}, 0]$ or $[0, T_{max}]$, and is less than the other approaches search range $[-T_{max}, T_{max}]$ such that searching and calculation amounts of the ITD parameter can be reduced, a performance requirement for an encoder is reduced, and processing efficiency of the encoder is improved.

BRIEF DESCRIPTION OF DRAWINGS

To describe the technical solutions in the embodiments of the present disclosure more clearly, the following briefly describes the accompanying drawings required for describing the embodiments of the present disclosure. The accompanying drawings in the following description show merely some embodiments of the present disclosure, and a person of ordinary skill in the art may still derive other drawings from these accompanying drawings without creative efforts.

DESCRIPTION OF EMBODIMENTS

The following clearly describes the technical solutions in the embodiments of the present disclosure with reference to the accompanying drawings in the embodiments of the present disclosure. The described embodiments are some but not all of the embodiments of the present disclosure. All other embodiments obtained by a person of ordinary skill in the art based on the embodiments of the present disclosure without creative efforts shall fall within the protection scope of the present disclosure.

Figure 1:
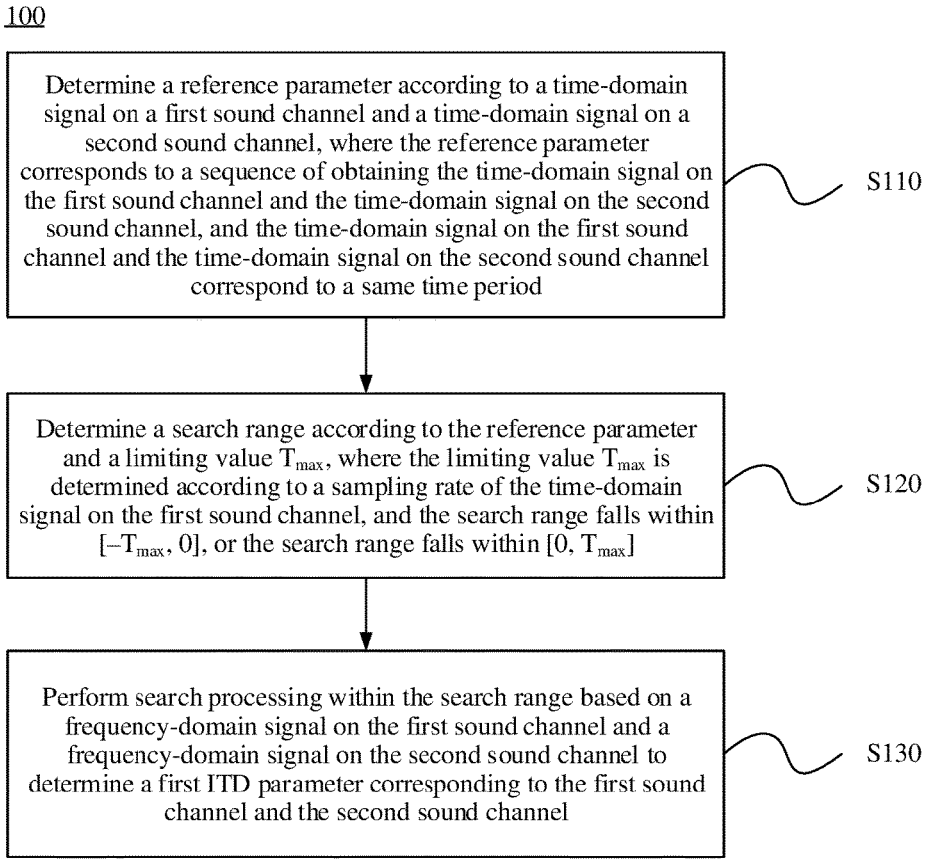
FIG. 1 is a schematic flowchart of a method for determining an ITD parameter according to an embodiment of the present disclosure.

FIG. 1 is a schematic flowchart of a method 100 for determining an ITD parameter according to an embodiment of the present disclosure. The method 100 may be performed by an encoder device (or may be referred to as a transmit end device) for transmitting an audio signal. As shown in FIG. 1, the method 100 includes the following steps.

Step S110: Determine a reference parameter according to a time-domain signal on a first sound channel and a time-domain signal on a second sound channel, where the reference parameter corresponds to a sequence of obtaining the time-domain signal on the first sound channel and the time-domain signal on the second sound channel, and the time-domain signal on the first sound channel and the time-domain signal on the second sound channel correspond to a same time period.

Step S120: Determine a search range according to the reference parameter and a limiting value $T_{max}$, where the limiting value $T_{max}$ is determined according to a sampling rate of the time-domain signal on the first sound channel, and the search range falls within $[-T_{max}, 0]$, or the search range falls within $[0, T_{max}]$.

Step S130: Perform search processing within the search range based on a frequency-domain signal on the first sound channel and a frequency-domain signal on the second sound channel to determine a first ITD parameter corresponding to the first sound channel and the second sound channel.

The method 100 for determining an ITD parameter in this embodiment of the present disclosure may be applied to an audio system that has at least two sound channels. In the audio system, mono signals from the at least two sound channels (that is, including a first sound channel and a second sound channel) are synthesized into a stereo signal. For example, a mono signal from an audio-left channel (that is, an example of the first sound channel) and a mono signal from an audio-right channel (that is, an example of the second sound channel) are synthesized into a stereo signal.

A parametric stereo (PS) technology may be used as an example of a method for transmitting the stereo signal. In the technology, an encoder converts the stereo signal into a mono signal and a spatial perception parameter according to a spatial perception feature, and separately encodes the mono signal and the spatial perception parameter. After obtaining mono audio, a decoder further restores the stereo signal according to the spatial perception parameter. In the technology, low-bit and high-quality transmission of the stereo signal can be implemented. An ITD parameter is a spatial perception parameter indicating a horizontal location of a sound source, and is an important part of the spatial perception parameter. This embodiment of the present disclosure is mainly related to a process of determining the ITD parameter. In addition, in this embodiment of the present disclosure, a process of encoding and decoding the stereo signal and the mono signal according to the ITD parameter is similar to that in the other approaches. To avoid repetition, a detailed description thereof is omitted herein.

It should be understood that the foregoing quantity of sound channels included in the audio system is merely an example for description, and the present disclosure is not limited thereto. For example, the audio system may have three or more sound channels, and mono signals from any two sound channels can be synthesized into a stereo signal. For ease of understanding, in an example for description below, the method 100 is applied to an audio system that has two sound channels (that is, an audio-left channel and an audio-right channel). In addition, for ease of differentiation, the audio-left channel is used as the first sound channel, and the audio-right channel is used as the second sound channel for description.

Further, in step S110, the encoder device may obtain, for example, using an audio input device such as a microphone corresponding to the audio-left channel, an audio signal corresponding to the audio-left channel, and perform sampling processing on the audio signal according to a preset sampling rate $\alpha$ (that is, an example of the sampling rate of the time-domain signal on the first sound channel) to generate a time-domain signal on the audio-left channel (that is, an example of the time-domain signal on the first sound channel, and denoted as a time-domain signal #L below for ease of understanding and differentiation). In addition, in this embodiment of the present disclosure, a process of obtaining the time-domain signal #L may be similar to that in the other approaches. To avoid repetition, a detailed description thereof is omitted herein.

In this embodiment of the present disclosure, the sampling rate of the time-domain signal on the first sound channel is the same as a sampling rate of the time-domain signal on the second sound channel. Therefore, similarly, the encoder device may obtain, for example, using an audio input device such as a microphone corresponding to the audio-right channel, an audio signal corresponding to the audio-right channel, and perform sampling processing on the audio signal according to the sampling rate $\alpha$, to generate a time-domain signal on the audio-right channel (that is, an example of the time-domain signal on the second sound channel, and denoted as a time-domain signal #R below for ease of understanding and differentiation).

It should be noted that in this embodiment of the present disclosure, the time-domain signal #L and the time-domain signal #R are time-domain signals corresponding to a same time period (or in other words, time-domain signals obtained in a same time period). For example, the time-domain signal #L and the time-domain signal #R may be time-domain signals corresponding to a same frame (that is, 20 milliseconds (ms)). In this case, an ITD parameter corresponding to signals in the frame can be obtained based on the time-domain signal #L and the time-domain signal #R.

For another example, the time-domain signal #L and the time-domain signal #R may be time-domain signals corresponding to a same subframe (that is, 10 ms, 5 ms, or the like) in a same frame. In this case, multiple ITD parameters corresponding to signals in the frame can be obtained based on the time-domain signal #L and the time-domain signal #R. For example, if a subframe corresponding to the time-domain signal #L and the time-domain signal #R is 10 ms, two ITD parameters can be obtained using signals in the frame (that is, 20 ms). For another example, if a subframe corresponding to the time-domain signal #L and the time-domain signal #R is 5 ms, four ITD parameters can be obtained using signals in the frame (that is, 20 ms).

It should be understood that the foregoing lengths of the time period corresponding to the time-domain signal #L and the time-domain signal #R are merely examples for description, and the present disclosure is not limited thereto. A length of the time period may be randomly changed according to a requirement.

Then, the encoder device may determine the reference parameter according to the time-domain signal #L and the time-domain signal #R. The reference parameter may be corresponding to a sequence of obtaining the time-domain signal #L and the time-domain signal #R (for example, a sequence of inputting the time-domain signal #L and the time-domain signal #R into the audio input device). Subsequently, the correspondence is described in detail with reference to a process of determining the reference parameter.

In this embodiment of the present disclosure, the reference parameter may be determined by performing cross-correlation processing on the time-domain signal #L and the time-domain signal #R (that is, in a manner 1), or the reference parameter may be determined by searching for maximum amplitude values of the time-domain signal #L and the time-domain signal #R (that is, in a manner 2). The following separately describes the manner 1 and the manner 2 in detail.

Manner 1:

Optionally, determining the reference parameter according to a time-domain signal on a first sound channel and a time-domain signal on a second sound channel includes performing cross-correlation processing on the time-domain signal on the first sound channel and the time-domain signal on the second sound channel to determine a first cross-correlation processing value and a second cross-correlation processing value, where the first cross-correlation processing value is a maximum function value, within a preset range, of a cross-correlation function of the time-domain signal on the first sound channel relative to the time-domain signal on the second sound channel, and the second cross-correlation processing value is a maximum function value, within the preset range, of a cross-correlation function of the time-domain signal on the second sound channel relative to the time-domain signal on the first sound channel, and determining the reference parameter according to a value relationship between the first cross-correlation processing value and the second cross-correlation processing value.

Further, in this embodiment of the present disclosure, the encoder device may determine, according to the following formula 1, a cross-correlation function $c_n(i)$ of the time-domain signal #L relative to the time-domain signal #R, that is:

$$c_n(i) = \sum_{j=0}^{Length-1-i} x_R(j) \cdot x_L(j+i),\ i \in [0, T_{max}]. \quad \text{formula 1}$$

$T_{max}$ indicates a limiting value of the ITD parameter (or in other words, a maximum value of an obtaining time difference between the time-domain signal #L and the time-domain signal #R), and may be determined according to the sampling rate $\alpha$. In addition, a method for determining $T_{max}$ may be similar to that in the other approaches. To avoid repetition, a detailed description thereof is omitted herein. $x_R(j)$ indicates a signal value of the time-domain signal #R at a $j^{th}$ sampling point, $x_L(j+i)$ indicates a signal value of the time-domain signal #L at a $(j+i)^{th}$ sampling point, and Length indicates a total quantity of sampling points included in the time-domain signal #R, or in other words, a length of the time-domain signal #R. For example, the length may be a length of a frame (that is, 20 ms), or a length of a subframe (that is, 10 ms, 5 ms, or the like).

In addition, the encoder device may determine a maximum value $$\max_{0 \le i \le T_{max}} (c_n(i))$$

of the cross-correlation function $c_n(i)$.

Similarly, the encoder device may determine, according to the following formula 2, a cross-correlation function $c_p(i)$ of the time-domain signal #R relative to the time-domain signal #L, that is:

$$c_p(i) = \sum_{j=0}^{Length-1-i} x_L(j) \cdot x_R(j+i). \quad \text{formula 2}$$

In addition, the encoder device may determine a maximum value $$\max_{0 \le i \le T_{max}} (c_p(i))$$

of the cross-correlation function $c_p(i)$.

In this embodiment of the present disclosure, the encoder device may determine a value of the reference parameter according to a relationship between $$\max_{0 \le i \le T_{max}} (c_n(i))$$

and $$\max_{0 \le i \le T_{max}} (c_p(i))$$

in the following manner 1A or manner 1B.

Figure 2:
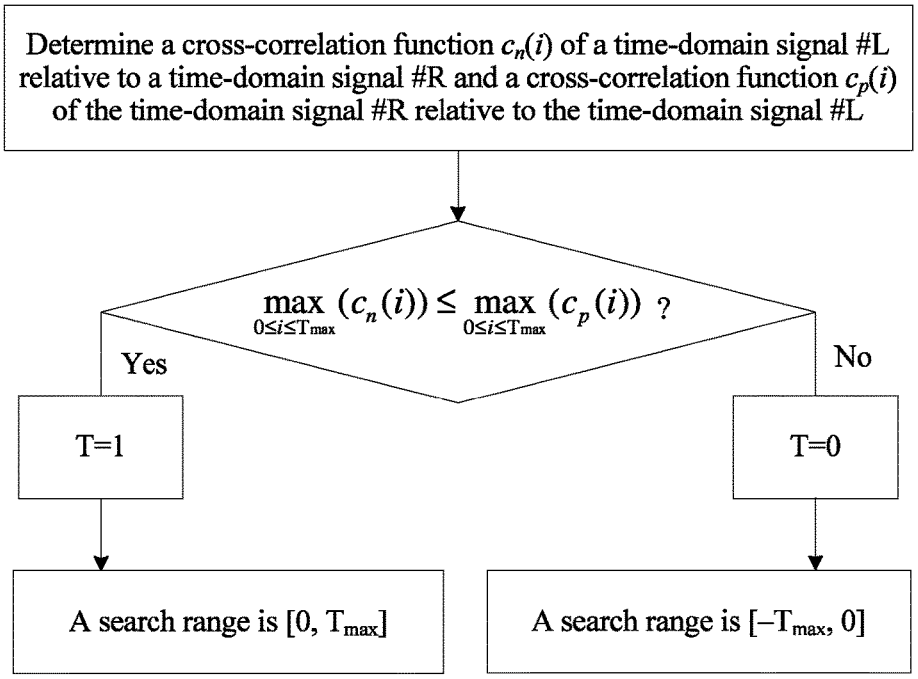
FIG. 2 is a schematic diagram of a process of determining a search range according to an embodiment of the present disclosure.

Manner 1A:

As shown in FIG. 2, determine a cross-correlation function $c_n(i)$ of a time-domain signal #L relative to a time-domain signal #R and a cross-correlation function $c_p(i)$ of the time-domain signal #R relative to the time-domain signal #L.

Further, as shown in FIG. 2, if $$\max_{0 \le i \le T_{max}} (c_n(i)) \le \max_{0 \le i \le T_{max}} (c_p(i)),$$

the encoder device may determine that the time-domain signal #L is obtained before the time-domain signal #R, that is, the ITD parameter of the audio-left channel and the audio-right channel is a positive number. In this case, the reference parameter T may be set to 1.

Therefore, in a determining process of step S120, the encoder device may determine that the reference parameter is greater than 0, and further determine that the search range is $[0, T_{max}]$. That is, when the time-domain signal #L is obtained before the time-domain signal #R, the ITD parameter is a positive number, and the search range is $[0, T_{max}]$ (that is, an example of the search range that falls within $[0, T_{max}]$).

Alternatively, if $$\max_{0 \le i \le T_{max}} (c_n(i)) > \max_{0 \le i \le T_{max}} (c_p(i)),$$

the encoder device may determine that the time-domain signal #L is obtained after the time-domain signal #R, that is, the ITD parameter of the audio-left channel and the audio-right channel is a negative number. In this case, the reference parameter T may be set to 0.

Therefore, in a determining process of step S120, the encoder device may determine that the reference parameter is not greater than 0, and further determine that the search range is $[-T_{max}, 0]$. That is, when the time-domain signal #L is obtained after the time-domain signal #R, the ITD parameter is a negative number, and the search range is $[-T_{max}, 0]$ (that is, an example of the search range that falls within $[-T_{max}, 0]$).

Manner 1B:

Optionally, the reference parameter is an index value corresponding to a larger one of the first cross-correlation processing value and the second cross-correlation processing value, or an opposite number of the index value.

Figure 3:
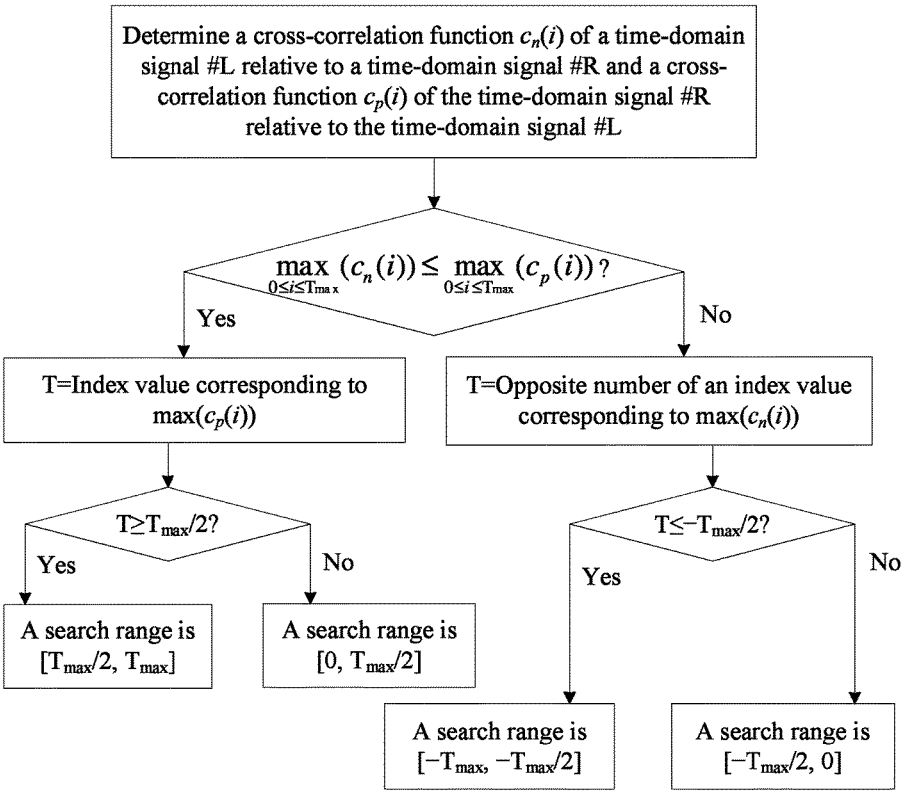
FIG. 3 is a schematic diagram of a process of determining a search range according to another embodiment of the present disclosure.

As shown in FIG. 3, determine a cross-correlation function $c_n(i)$ of a time-domain signal #L relative to a time-domain signal #R and a cross-correlation function $c_p(i)$ of the time-domain signal #R relative to the time-domain signal #L.

Further, as shown in FIG. 3, if $$\max_{0 \le i \le T_{max}} (c_n(i)) \le \max_{0 \le i \le T_{max}} (c_p(i)),$$

the encoder device may determine that the time-domain signal #L is obtained before the time-domain signal #R, that is, the ITD parameter of the audio-left channel and the audio-right channel is a positive number. In this case, the reference parameter T may be set to an index value corresponding to $$\max_{0 \le i \le T_{max}} (c_p(i)).$$

Therefore, in a subsequent determining process, after determining that the reference parameter T is greater than 0, the encoder device may further determine whether the reference parameter T is greater than or equal to $T_{max}/2$, and determine the search range according to a determining result. For example, when $T \ge T_{max}/2$, the search range is $[T_{max}/2, T_{max}]$ (that is, an example of the search range that falls within $[0, T_{max}]$. When $T < T_{max}/2$, the search range is $[0, T_{max}/2]$ (that is, another example of the search range that falls within $[0, T_{max}]$).

Alternatively, if $$\max_{0 \le i \le T_{max}} (c_n(i)) > \max_{0 \le i \le T_{max}} (c_p(i)),$$

the encoder device may determine that the time-domain signal #L is obtained after the time-domain signal #R, that is, the ITD parameter of the audio-left channel and the audio-right channel is a negative number. In this case, the reference parameter T may be set to an opposite number of an index value corresponding to $$\max_{0 \le i \le T_{max}} (c_n(i)).$$

Therefore, in a determining process of step S120, after determining that the reference parameter T is less than or equal to 0, the encoder device may further determine whether the reference parameter T is less than or equal to $-T_{max}/2$, and determine the search range according to a determining result. For example, when $T \le -T_{max}/2$, the search range is $[-T_{max}, -T_{max}/2]$ (that is, an example of the search range that falls within $[-T_{max}, 0]$. When $T > -T_{max}/2$, the search range is $[-T_{max}/2, 0]$ (that is, another example of the search range that falls within $[-T_{max}, 0]$.

Manner 2:

Optionally, determining the reference parameter according to a time-domain signal on a first sound channel and a time-domain signal on a second sound channel includes performing peak detection processing on the time-domain signal on the first sound channel and the time-domain signal on the second sound channel, to determine a first index value and a second index value, where the first index value is an index value corresponding to a maximum amplitude value of the time-domain signal on the first sound channel within a preset range, and the second index value is an index value corresponding to a maximum amplitude value of the time-domain signal on the second sound channel within the preset range, and determining the reference parameter according to a value relationship between the first index value and the second index value.

Further, in this embodiment of the present disclosure, the encoder device may detect a maximum value max(L(j)), $j \in [0, Length-1]$ of an amplitude value (denoted as L(j)) of the time-domain signal #L, and record an index value $p_{left}$ corresponding to max(L(j)). Length indicates a total quantity of sampling points included in the time-domain signal #L.

In addition, the encoder device may detect a maximum value max(R(j)), $j \in [0, Length-1]$ of an amplitude value (denoted as R(j)) of the time-domain signal #R, and record an index value $p_{right}$ corresponding to max(R(j)). Length indicates a total quantity of sampling points included in the time-domain signal #R.

Then, the encoder device may determine a value relationship between $p_{left}$ and $p_{right}$.

Figure 4:
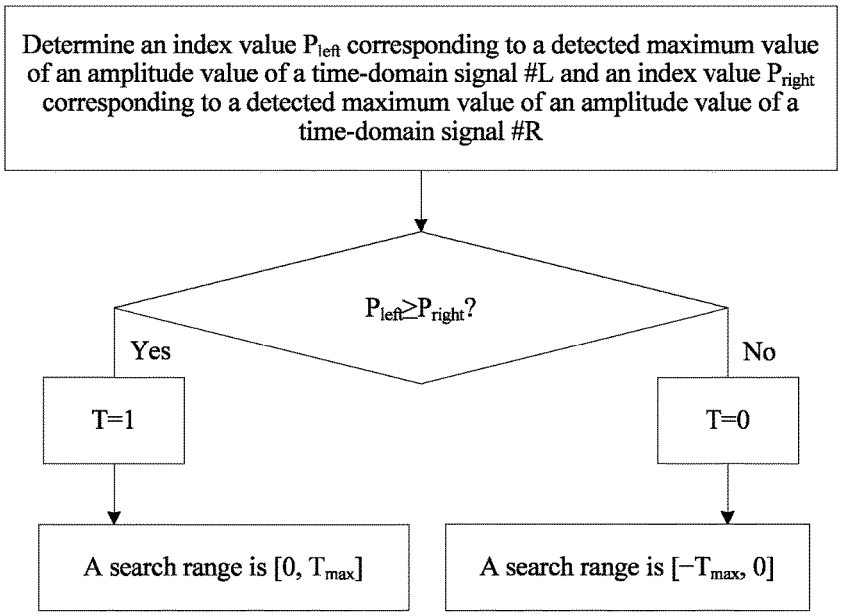
FIG. 4 is a schematic diagram of a process of determining a search range according to still another embodiment of the present disclosure.

As shown in FIG. 4, determine an index value $P_{left}$ corresponding to a detected maximum value of an amplitude value of a time-domain signal #L and an index value $P_{right}$ corresponding to a detected maximum value of an amplitude value of a time-domain signal #R.

Further, as shown in FIG. 4, if $p_{left} \ge p_{right}$, the encoder device may determine that the time-domain signal #L is obtained before the time-domain signal #R, that is, the ITD parameter of the audio-left channel and the audio-right channel is a positive number. In this case, the reference parameter T may be set to 1.

Therefore, in a determining process of step S120, the encoder device may determine that the reference parameter is greater than 0, and further determine that the search range is $[0, T_{max}]$. That is, when the time-domain signal #L is obtained before the time-domain signal #R, the ITD parameter is a positive number, and the search range is $[0, T_{max}]$ (that is, an example of the search range that falls within $[0, T_{max}]$).

Alternatively, if $p_{left} < p_{right}$, the encoder device may determine that the time-domain signal #L is obtained after the time-domain signal #R, that is, the ITD parameter of the audio-left channel and the audio-right channel is a negative number. In this case, the reference parameter T may be set to 0.

Therefore, in a determining process of S120, the encoder device may determine that the reference parameter is not greater than 0, and further determine that the search range is $[-T_{max}, 0]$. That is, when the time-domain signal #L is obtained after the time-domain signal #R, the ITD parameter is a negative number, and the search range is $[-T_{max}, 0]$ (that is, an example of the search range that falls within $[-T_{max}, 0]$).

In step S130, the encoder device may perform time-to-frequency transformation processing on the time-domain signal #L to obtain a frequency-domain signal on the audio-left channel (that is, an example of the frequency-domain signal on the first sound channel, and denoted as a frequency-domain signal #L below for ease of understanding and differentiation), and may perform time-to-frequency transformation processing on the time-domain signal #R to obtain a frequency-domain signal on the audio-right channel (that is, an example of the frequency-domain signal on the second sound channel, and denoted as a frequency-domain signal #R below for ease of understanding and differentiation).

For example, in this embodiment of the present disclosure, the time-to-frequency transformation processing may be performed using a Fast Fourier Transformation (FFT) technology based on the following formula 3:

$$X(k) = \sum_{n=0}^{Length} x(n) \cdot e^{-j\frac{2\pi \cdot n \cdot k}{FFT_LENGTH}}, \quad 0 \le k < \text{FFT_LENGTH} \qquad \text{formula 3}$$

X(k) indicates a frequency-domain signal, FFT_LENGTH indicates a time-to-frequency transformation length, x(n) indicates a time-domain signal (that is, the time-domain signal #L or the time-domain signal #R), and Length indicates a total quantity of sampling points included in the time-domain signal.

It should be understood that the foregoing process of the time-to-frequency transformation processing is merely an example for description, and the present disclosure is not limited thereto. A method and a process of the time-to-frequency transformation processing may be similar to those in the other approaches. For example, a technology such as modified discrete cosine transform (MDCT) may be used.

Therefore, the encoder device may perform search processing on the determined frequency-domain signal #L and frequency-domain signal #R within the determined search range, to determine the ITD parameter of the audio-left channel and the audio-right channel. For example, the following search processing process may be used.

First, the encoder device may classify FFT_LENGTH frequencies of a frequency-domain signal into $N_{subband}$ subbands (for example, one subband) according to preset bandwidth A. A frequency included in a $k^{th}$ subband $A_k$ meets $A_{k-1} \le b \le A_k - 1$.

Within the foregoing search range, a correlation function mag(j) of the frequency-domain signal #L is calculated according to the following formula 4:

$$mag(j) = \sum_{b=A_{k-1}}^{A_k-1} X_L(b) * X_R(b) * \exp\left(\frac{2\pi * b * j}{\text{FFT_LENFTH}}\right). \qquad \text{formula 4}$$

$X_L(b)$ indicates a signal value of the frequency-domain signal #L on a $b^{th}$ frequency, $X_R(b)$ indicates a signal value of the frequency-domain signal #R on the $b^{th}$ frequency, FFT_LENGTH indicates a time-to-frequency transformation length, and a value range of j is the determined search range. For ease of understanding and description, the search range is denoted as [a, b].

An ITD parameter value of the $k^{th}$ subband is $$T(k) = \underset{a \le j \le b}{\operatorname{argmax}}(mag(j)),$$

that is, an index value corresponding to a maximum value of mag(j).

Therefore, one or more (corresponding to the determined quantity of subbands) ITD parameter values of the audio-left channel and the audio-right channel may be obtained.

Then, the encoder device may further perform quantization processing and the like on the ITD parameter value, and send the processed ITD parameter value and a mono signal obtained after processing such as downmixing is performed on signals on the audio-left channel and the audio-right channel to a decoder device (or in other words, a receive end device).

The decoder device may restore a stereo audio signal according to the mono audio signal and the ITD parameter value.

Optionally, the method further includes performing smoothing process on the first ITD parameter based on a second ITD parameter, where the first ITD parameter is an ITD parameter in a first time period, the second ITD parameter is a smoothed value of an ITD parameter in a second time period, and the second time period is before the first time period.

Further, in this embodiment of the present disclosure, before performing quantization processing on the ITD parameter value, the encoder device may further perform smoothing processing on the determined ITD parameter value. As an example rather than a limitation, the encoder device may perform the smoothing processing according to the following formula 5:

$$T_{sm}(k) = w_1 * T_{sm}^{[-1]}(k) + w_2 * T(k) \qquad \text{formula 5.}$$

$T_{sm}(k)$ indicates an ITD parameter value on which smoothing processing has been performed and that corresponds to a $k^{th}$ frame or a $k^{th}$ subframe, $T_{sm}^{[-1]}$ indicates an ITD parameter value on which smoothing processing has been performed and that corresponds to a $(k-1)^{th}$ frame or a $(k-1)^{th}$ subframe, T(k) indicates an ITD parameter value on which smoothing processing has not been performed and that corresponds to the $k^{th}$ frame or the $k^{th}$ subframe, $w_1$ and $w_2$ are smoothing factors, and $w_1$ and $w_2$ may be set to constants, or $w_1$ and $w_2$ may be set according to a difference between $T_{sm}^{[-1]}$ and T(k) provided that $w_1 + w_2 = 1$ is met. In addition, when k=1, $T_{sm}^{[-1]}$ may be a preset value.

It should be noted that in the method for determining an ITD parameter in this embodiment of the present disclosure, the smoothing processing may be performed by the encoder device, or may be performed by the decoder device, and this is not particularly limited in the present disclosure. That is, the encoder device may directly send the obtained ITD parameter value to the decoder device without performing smoothing process, and the decoder device performs smoothing processing on the ITD parameter value. In addition, a method and a process of performing smoothing process by the decoder device may be similar to the foregoing method and process of performing smoothing process by the encoder device. To avoid repetition, a detailed description thereof is omitted herein.

According to the method for determining an ITD parameter in this embodiment of the present disclosure, a reference parameter corresponding to a sequence of obtaining a time-domain signal on a first sound channel and a time-domain signal on a second sound channel is determined in a time domain, a search range can be determined based on the reference parameter, and search processing on a frequency-domain signal on the first sound channel and a frequency-domain signal on the second sound channel is performed within the search range in a frequency domain to determine an ITD parameter corresponding to the first sound channel and the second sound channel. In this embodiment of the present disclosure, the search range determined according to the reference parameter falls within $[-T_{max}, 0]$ or $[0, T_{max}]$, and is less than the other approaches search range $[-T_{max}, T_{max}]$ such that searching and calculation amounts of the ITD parameter can be reduced, a performance requirement for an encoder is reduced, and processing efficiency of the encoder is improved.

The method for determining an ITD parameter according to the embodiments of the present disclosure is described above in detail with reference to FIG. 1 to FIG. 4. An apparatus for determining an ITD parameter according to an embodiment of the present disclosure is described below in detail with reference to FIG. 5.

Figure 5:
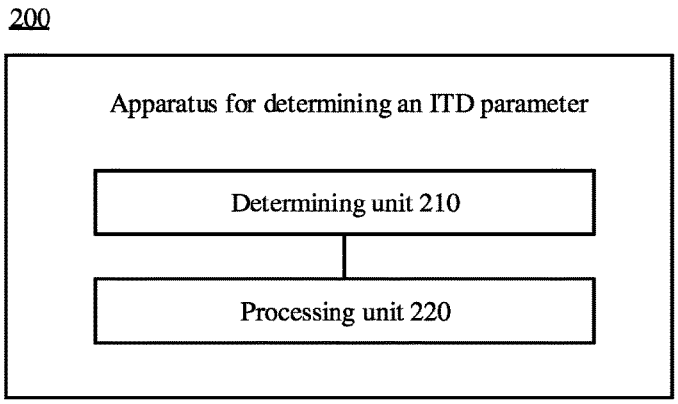
FIG. 5 is a schematic block diagram of an apparatus for determining an ITD parameter according to an embodiment of the present disclosure.

FIG. 5 is a schematic block diagram of an apparatus 200 for determining an ITD parameter according to an embodiment of the present disclosure. As shown in FIG. 5, the apparatus 200 includes a determining unit 210 configured to determine a reference parameter according to a time-domain signal on a first sound channel and a time-domain signal on a second sound channel, where the reference parameter corresponds to a sequence of obtaining the time-domain signal on the first sound channel and the time-domain signal on the second sound channel, and the time-domain signal on the first sound channel and the time-domain signal on the second sound channel correspond to a same time period, and determine a search range according to the reference parameter and a limiting value $T_{max}$, where the limiting value $T_{max}$ is determined according to a sampling rate of the time-domain signal on the first sound channel, and the search range falls within $[-T_{max}, 0]$, or the search range falls within $[0, T_{max}]$, and a processing unit 220 configured to perform search processing within the search range based on a frequency-domain signal on the first sound channel and a frequency-domain signal on the second sound channel, to determine a first ITD parameter corresponding to the first sound channel and the second sound channel.

Optionally, the determining unit 210 is further configured to perform cross-correlation processing on the time-domain signal on the first sound channel and the time-domain signal on the second sound channel, to determine a first cross-correlation processing value and a second cross-correlation processing value, and determine the reference parameter according to a value relationship between the first cross-correlation processing value and the second cross-correlation processing value. The first cross-correlation processing value is a maximum function value, within a preset range, of a cross-correlation function of the time-domain signal on the first sound channel relative to the time-domain signal on the second sound channel, and the second cross-correlation processing value is a maximum function value, within the preset range, of a cross-correlation function of the time-domain signal on the second sound channel relative to the time-domain signal on the first sound channel.

Optionally, the determining unit 210 is further configured to determine an index value corresponding to a larger one of the first cross-correlation processing value and the second cross-correlation processing value or an opposite number of the index value as the reference parameter.

Optionally, the determining unit 210 is further configured to perform peak detection processing on the time-domain signal on the first sound channel and the time-domain signal on the second sound channel, to determine a first index value and a second index value, and determine the reference parameter according to a value relationship between the first index value and the second index value. The first index value is an index value corresponding to a maximum amplitude value of the time-domain signal on the first sound channel within a preset range, and the second index value is an index value corresponding to a maximum amplitude value of the time-domain signal on the second sound channel within the preset range.

Optionally, the processing unit 220 is further configured to perform smoothing processing on the first ITD parameter based on a second ITD parameter. The first ITD parameter is an ITD parameter in a first time period, the second ITD parameter is a smoothed value of an ITD parameter in a second time period, and the second time period is before the first time period.

The apparatus 200 for determining an ITD parameter according to this embodiment of the present disclosure is configured to perform the method 100 for determining an ITD parameter in the embodiments of the present disclosure, and may be corresponding to the encoder device in the method in the embodiments of the present disclosure. In addition, units and modules in the apparatus 200 for determining an ITD parameter and the foregoing other operations and/or functions are separately intended to implement a corresponding procedure in the method 100 in FIG. 1. For brevity, details are not described herein.

According to the apparatus 200 for determining an ITD parameter in this embodiment of the present disclosure, a reference parameter corresponding to a sequence of obtaining a time-domain signal on a first sound channel and a time-domain signal on a second sound channel is determined in a time domain, a search range can be determined based on the reference parameter, and search processing on a frequency-domain signal on the first sound channel and a frequency-domain signal on the second sound channel is performed within the search range in a frequency domain, to determine an ITD parameter corresponding to the first sound channel and the second sound channel. In this embodiment of the present disclosure, the search range determined according to the reference parameter falls within $[-T_{max}, 0]$ or $[0, T_{max}]$, and is less than the other approaches search range $[-T_{max}, T_{max}]$ such that searching and calculation amounts of the ITD parameter can be reduced, a performance requirement for an encoder is reduced, and processing efficiency of the encoder is improved.

The method for determining an ITD parameter according to the embodiments of the present disclosure is described above in detail with reference to FIG. 1 to FIG. 4. A device for determining an ITD parameter according to an embodiment of the present disclosure is described below in detail with reference to FIG. 6.

Figure 6:
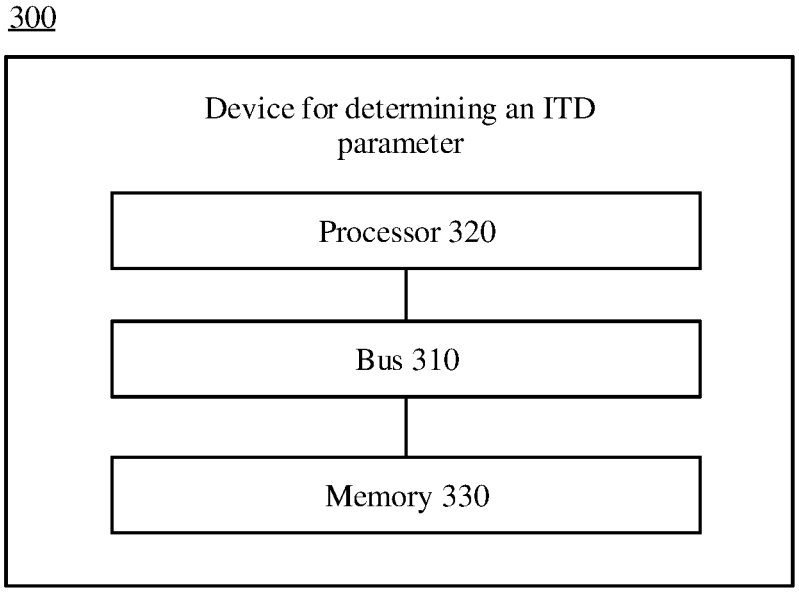
FIG. 6 is a schematic structural diagram of a device for determining an ITD parameter according to an embodiment of the present disclosure.

FIG. 6 is a schematic block diagram of a device 300 for determining an ITD parameter according to an embodiment of the present disclosure. As shown in FIG. 6, the device 300 may include a bus 310, a processor 320 connected to the bus 310, and a memory 330 connected to the bus 310.

The processor 320 invokes, using the bus 310, a program stored in the memory 330 in order to determine a reference parameter according to a time-domain signal on a first sound channel and a time-domain signal on a second sound channel, where the reference parameter corresponds to a sequence of obtaining the time-domain signal on the first sound channel and the time-domain signal on the second sound channel, and the time-domain signal on the first sound channel and the time-domain signal on the second sound channel correspond to a same time period, determine a search range according to the reference parameter and a limiting value $T_{max}$, where the limiting value $T_{max}$ is determined according to a sampling rate of the time-domain signal on the first sound channel, and the search range falls within $[-T_{max}, 0]$, or the search range falls within $[0, T_{max}]$, and perform search processing within the search range based on a frequency-domain signal on the first sound channel and a frequency-domain signal on the second sound channel to determine a first ITD parameter corresponding to the first sound channel and the second sound channel.

Optionally, the processor 320 is further configured to perform cross-correlation processing on the time-domain signal on the first sound channel and the time-domain signal on the second sound channel to determine a first cross-correlation processing value and a second cross-correlation processing value, where the first cross-correlation processing value is a maximum function value, within a preset range, of a cross-correlation function of the time-domain signal on the first sound channel relative to the time-domain signal on the second sound channel, and the second cross-correlation processing value is a maximum function value, within the preset range, of a cross-correlation function of the time-domain signal on the second sound channel relative to the time-domain signal on the first sound channel, and determine the reference parameter according to a value relationship between the first cross-correlation processing value and the second cross-correlation processing value.

Optionally, the reference parameter is an index value corresponding to a larger one of the first cross-correlation processing value and the second cross-correlation processing value, or an opposite number of the index value.

Optionally, the processor 320 is further configured to perform peak detection processing on the time-domain signal on the first sound channel and the time-domain signal on the second sound channel to determine a first index value and a second index value, where the first index value is an index value corresponding to a maximum amplitude value of the time-domain signal on the first sound channel within a preset range, and the second index value is an index value corresponding to a maximum amplitude value of the time-domain signal on the second sound channel within the preset range, and determine the reference parameter according to a value relationship between the first index value and the second index value.

Optionally, the processor 320 is further configured to perform smoothing process on the first ITD parameter based on a second ITD parameter, the first ITD parameter is an ITD parameter in a first time period, the second ITD parameter is a smoothed value of an ITD parameter in a second time period, and the second time period is before the first time period.

In this embodiment of the present disclosure, components of the device 300 are coupled together using the bus 310. In addition to a data bus, the bus 310 further includes a power supply bus, a control bus, and a status signal bus. However, for clarity of description, various buses are marked as the bus 310 in the FIG. 6.

The processor 320 may implement or perform the steps and the logical block diagrams disclosed in the method embodiments of the present disclosure. The processor 320 may be a microprocessor, or the processor 320 may be any conventional processor or decoder, or the like. The steps of the methods disclosed with reference to the embodiments of the present disclosure may be directly performed and completed by means of a hardware processor, or may be performed and completed using a combination of hardware and software modules in a decoding processor. The software module may be located in a mature storage medium in the art, such as a random access memory (RAM), a flash memory, a read-only memory (ROM), a programmable ROM (PROM), an electrically-erasable PROM (EEPROM), or a register. The storage medium is located in the memory 330, and the processor 320 reads information in the memory 330 and completes the steps in the foregoing methods in combination with hardware of the processor 320.

It should be understood that in this embodiment of the present disclosure, the processor 320 may be a central processing unit (CPU), or the processor 320 may be another general-purpose processor, a digital signal processor (DSP), an application-specific integrated circuit (ASIC), a field programmable gate array (FPGA), another programmable logical device, a discrete gate or a transistor logical device, a discrete hardware component, or the like. The general-purpose processor may be a microprocessor, or the processor 320 may be any conventional processor, or the like.

The memory 330 may include a ROM and a RAM, and provide an instruction and data for the processor 320. A part of the memory 330 may further include a nonvolatile RAM (NVRAM). For example, the memory 330 may further store information about a device type.

In an implementation process, the steps in the foregoing methods may be completed by an integrated logic circuit of hardware in the processor 320 or an instruction in a form of software. The steps of the methods disclosed with reference to the embodiments of the present disclosure may be directly performed and completed by means of a hardware processor, or may be performed and completed using a combination of hardware and software modules in the processor. The software module may be located in a mature storage medium in the art, such as a RAM, a flash memory, a ROM, a PROM, an EEPROM, or a register.

The device 300 for determining an ITD parameter according to this embodiment of the present disclosure is configured to perform the method 100 for determining an ITD parameter in the embodiments of the present disclosure, and may correspond to the encoder device in the method in the embodiments of the present disclosure. In addition, units and modules in the device 300 for determining an ITD parameter and the foregoing other operations and/or functions are separately intended to implement a corresponding procedure in the method 100 in FIG. 1. For brevity, details are not described herein.

According to the device for determining an ITD parameter in this embodiment of the present disclosure, a reference parameter corresponding to a sequence of obtaining a time-domain signal on a first sound channel and a time-domain signal on a second sound channel is determined in a time domain, a search range can be determined based on the reference parameter, and search processing on a frequency-domain signal on the first sound channel and a frequency-domain signal on the second sound channel is performed within the search range in a frequency domain to determine an ITD parameter corresponding to the first sound channel and the second sound channel. In this embodiment of the present disclosure, the search range determined according to the reference parameter falls within $[-T_{max}, 0]$ or $[0, T_{max}]$, and is less than the other approaches search range $[-T_{max}, T_{max}]$ such that searching and calculation amounts of the ITD parameter can be reduced, a performance requirement for an encoder is reduced, and processing efficiency of the encoder is improved.

It should be understood that sequence numbers of the foregoing processes do not mean execution sequences in the embodiments of the present disclosure. The execution sequences of the processes should be determined according to functions and internal logic of the processes, and should not be construed as any limitation on the implementation processes of the embodiments of the present disclosure.

A person of ordinary skill in the art may be aware that, in combination with the examples described in the embodiments disclosed in this specification, units and algorithm steps may be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of the present disclosure.

It may be clearly understood by a person skilled in the art that, for the purpose of convenient and brief description, for a detailed working process of the foregoing system, apparatus, and unit, refer to a corresponding process in the foregoing method embodiments, and details are not described herein again.

In the several embodiments provided in this application, it should be understood that the disclosed system, apparatus, and method may be implemented in other manners. For example, the described apparatus embodiment is merely an example. For example, the unit division is merely logical function division and may be other division during actual implementation. For example, multiple units or components may be combined or integrated into another system, or some features may be ignored or not performed. In addition, the displayed or discussed mutual couplings or direct couplings or communication connections may be implemented using some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on multiple network units. Some or all of the units may be selected according to actual requirements to achieve the objectives of the solutions of the embodiments.

In addition, functional units in the embodiments of the present disclosure may be integrated into one processing unit, or each of the units may exist alone physically, or two or more units are integrated into one unit.

When the functions are implemented in the form of a software functional unit and sold or used as an independent product, the functions may be stored in a computer-readable storage medium. Based on such an understanding, the technical solutions of the present disclosure essentially, or the part contributing to the other approaches, or some of the technical solutions may be implemented in a form of a software product. The software product is stored in a storage medium, and includes several instructions for instructing a computer device (which may be a personal computer, a server, or a network device) to perform all or some of the steps of the methods described in the embodiments of the present disclosure. The foregoing storage medium includes any medium that can store program code, such as a universal serial bus (USB) flash drive, a removable hard disk, a ROM, a RAM, a magnetic disk, or an optical disc.

The foregoing descriptions are merely specific implementations of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. A method for determining an inter-channel time difference (ITD) parameter, comprising:

determining a reference parameter according to a time-domain signal on a first sound channel and a time-domain signal on a second sound channel, wherein the reference parameter corresponds to a sequence of obtaining the time-domain signal on the first sound channel and the time-domain signal on the second sound channel, and wherein the time-domain signal on the first sound channel and the time-domain signal on the second sound channel correspond to a first time period;

determining a search range according to the reference parameter and a limiting value ($T_{max}$), wherein the $T_{max}$ is determined according to a sampling rate of the time-domain signal on the first sound channel, and wherein the search range either falls within $[-T_{max}, 0]$ or falls within $[0, T_{max}]$; and performing search processing within the search range based on a frequency-domain signal on the first sound channel and a frequency-domain signal on the second sound channel to determine a first ITD parameter corresponding to the first sound channel and the second sound channel.

2. The method according to claim 1, wherein determining the reference parameter comprises:

performing cross-correlation processing on the time-domain signal on the first sound channel and the time-domain signal on the second sound channel to determine a first cross-correlation processing value and a second cross-correlation processing value, wherein the first cross-correlation processing value is a maximum function value, within a preset range, of a cross-correlation function of the time-domain signal on the first sound channel relative to the time-domain signal on the second sound channel, and wherein the second cross-correlation processing value is a maximum function value, within the preset range, of a cross-correlation function of the time-domain signal on the second sound channel relative to the time-domain signal on the first sound channel; and determining the reference parameter according to a value relationship between the first cross-correlation processing value and the second cross-correlation processing value.

3. The method according to claim 2, wherein the reference parameter is an index value corresponding to a larger one of the first cross-correlation processing value and the second cross-correlation processing value.

4. The method according to claim 2, wherein the reference parameter is an opposite number of an index value corresponding to a larger one of the first cross-correlation processing value and the second cross-correlation processing value.

5. The method according to claim 1, wherein determining the reference parameter comprises:

performing peak detection processing on the time-domain signal on the first sound channel and the time-domain signal on the second sound channel to determine a first index value and a second index value, wherein the first index value corresponds to a maximum amplitude value of the time-domain signal on the first sound channel within a preset range, and wherein the second index value corresponds to a maximum amplitude value of the time-domain signal on the second sound channel within the preset range; and determining the reference parameter according to a value relationship between the first index value and the second index value.

6. The method according to claim 1, further comprising performing smoothing processing on the first ITD parameter based on a second ITD parameter, wherein the second ITD parameter is a smoothed value of an ITD parameter in a second time period, and wherein the second time period is before the first time period.

7. The method according to claim 1, wherein the search range is $[T_{max}/2, T_{max}]$, $[0, T_{max}/2]$, $[-T_{max}, -T_{max}/2]$, or $[-T_{max}/2, 0]$.

8. An apparatus for determining an inter-channel time difference (ITD) parameter, comprising:

a memory comprising instructions; and a processor coupled to the memory, wherein the instructions cause the processor to be configured to:

determine a reference parameter according to a time-domain signal on a first sound channel and a time-domain signal on a second sound channel, wherein the reference parameter corresponds to a sequence of obtaining the time-domain signal on the first sound channel and the time-domain signal on the second sound channel, and wherein the time-domain signal on the first sound channel and the time-domain signal on the second sound channel correspond to a first time period;

determine a search range according to the reference parameter and a limiting value ($T_{max}$), wherein the $T_{max}$ is determined according to a sampling rate of the time-domain signal on the first sound channel, and wherein the search range either falls within $[-T_{max}, 0]$ or falls within $[0, T_{max}]$; and perform search processing within the search range based on a frequency-domain signal on the first sound channel and a frequency-domain signal on the second sound channel to determine a first ITD parameter corresponding to the first sound channel and the second sound channel.

9. The apparatus according to claim 8, wherein the instructions further cause the processor to be configured to:

perform cross-correlation processing on the time-domain signal on the first sound channel and the time-domain signal on the second sound channel to determine a first cross-correlation processing value and a second cross-correlation processing value; and determine the reference parameter according to a value relationship between the first cross-correlation processing value and the second cross-correlation processing value, wherein the first cross-correlation processing value is a maximum function value, within a preset range, of a cross-correlation function of the time-domain signal on the first sound channel relative to the time-domain signal on the second sound channel, and wherein the second cross-correlation processing value is a maximum function value, within the preset range, of a cross-correlation function of the time-domain signal on the second sound channel relative to the time-domain signal on the first sound channel.

10. The apparatus according to claim 9, wherein the reference parameter is an index value corresponding to a larger one of the first cross-correlation processing value and the second cross-correlation processing value.

11. The apparatus according to claim 9, wherein the reference parameter is an opposite number of an index value corresponding to a larger one of the first cross-correlation processing value and the second cross-correlation processing value.

12. The apparatus according to claim 8, wherein the instructions further cause the processor to be configured to:

perform peak detection processing on the time-domain signal on the first sound channel and the time-domain signal on the second sound channel to determine a first index value and a second index value; and determine the reference parameter according to a value relationship between the first index value and the second index value, wherein the first index value corresponds to a maximum amplitude value of the time-domain signal on the first sound channel within a preset range, and wherein the second index value corresponds to a maximum amplitude value of the time-domain signal on the second sound channel within the preset range.

13. The apparatus according to claim 8, wherein the instructions further cause the processor to be configured to perform smoothing processing on the first ITD parameter based on a second ITD parameter, wherein the second ITD parameter is a smoothed value of an ITD parameter in a second time period, and wherein the second time period is before the first time period.

14. The apparatus according to claim 8, wherein the search range is $[T_{max}/2, T_{max}]$, $[0, T_{max}/2]$, $[-T_{max}, -T_{max}/2]$, or $[-T_{max}/2, 0]$.

15. A non-transitory computer readable storage medium, tangibly embodying computer program code, in which, when executed by a computer, causes the computer to perform a method comprising:

determining a reference parameter according to a time-domain signal on a first sound channel and a time-domain signal on a second sound channel, wherein the reference parameter corresponds to a sequence of obtaining the time-domain signal on the first sound channel and the time-domain signal on the second sound channel, and wherein the time-domain signal on the first sound channel and the time-domain signal on the second sound channel correspond to a first time period;

determining a search range according to the reference parameter and a limiting value ($T_{max}$), wherein the $T_{max}$ is determined according to a sampling rate of the time-domain signal on the first sound channel, and wherein the search range either falls within $[-T_{max}, 0]$ or falls within $[0, T_{max}]$; and performing search processing within the search range based on a frequency-domain signal on the first sound channel and a frequency-domain signal on the second sound channel to determine a first inter-channel time difference (ITD) parameter corresponding to the first sound channel and the second sound channel.

16. The non-transitory computer readable storage medium according to claim 15, wherein determining the reference parameter comprises:

performing cross-correlation processing on the time-domain signal on the first sound channel and the time-domain signal on the second sound channel to determine a first cross-correlation processing value and a second cross-correlation processing value, wherein the first cross-correlation processing value is a maximum function value, within a preset range, of a cross-correlation function of the time-domain signal on the first sound channel relative to the time-domain signal on the second sound channel, and wherein the second cross-correlation processing value is a maximum function value, within the preset range, of a cross-correlation function of the time-domain signal on the second sound channel relative to the time-domain signal on the first sound channel; and determining the reference parameter according to a value relationship between the first cross-correlation processing value and the second cross-correlation processing value.

17. The non-transitory computer readable storage medium according to claim 16, wherein the reference parameter is an index value corresponding to a larger one of the first cross-correlation processing value and the second cross-correlation processing value.

18. The non-transitory computer readable storage medium according to claim 16, wherein the reference parameter is an opposite number of an index value corresponding to a larger one of the first cross-correlation processing value and the second cross-correlation processing value.

19. The non-transitory computer readable storage medium according to claim 15, wherein determining the reference parameter comprises:

performing peak detection processing on the time-domain signal on the first sound channel and the time-domain signal on the second sound channel to determine a first index value and a second index value, wherein the first index value corresponds to a maximum amplitude value of the time-domain signal on the first sound channel within a preset range, and wherein the second index value corresponds to a maximum amplitude value of the time-domain signal on the second sound channel within the preset range; and determining the reference parameter according to a value relationship between the first index value and the second index value.

20. The non-transitory computer readable storage medium according to claim 15, further comprising performing smoothing processing on the first ITD parameter based on a second ITD parameter, wherein the second ITD parameter is a smoothed value of an ITD parameter in a second time period, and wherein the second time period is before the first time period.

* * * * *